US007472850B2

(12) United States Patent
Stauch et al.

(10) Patent No.: US 7,472,850 B2
(45) Date of Patent: Jan. 6, 2009

(54) ULTRASONIC STANDING-WAVE ATOMIZER ARRANGEMENT

(75) Inventors: Gert Stauch, Wiesloch/Baiertal (DE); Bjoern Mattias, Bad Schoenborn (DE); Uwe Goerges, Bochum (DE); Gunter Boerner, Sinsheim/Eschelbach (DE); Hidetoshi Yamabe, Tokyo (JP); Josef Wittmann, Hockenheim (DE)

(73) Assignee: ABB Patent GmbH, Ladenburg (DE)

( * ) Notice: Subject to any disclaimer, the term of this patent is extended or adjusted under 35 U.S.C. 154(b) by 268 days.

(21) Appl. No.: 10/560,278

(22) PCT Filed: May 29, 2004

(86) PCT No.: PCT/EP2004/005864

§ 371 (c)(1),
(2), (4) Date: May 1, 2006

(87) PCT Pub. No.: WO2004/110649

PCT Pub. Date: Dec. 23, 2004

(65) Prior Publication Data

US 2007/0012797 A1 Jan. 18, 2007

(30) Foreign Application Priority Data

Jun. 18, 2003 (DE) ..... 103 27 430

(51) Int. Cl.
*B05B 5/00* (2006.01)
*F23D 11/32* (2006.01)
*B05D 1/40* (2006.01)

(52) U.S. Cl. ..... 239/697; 239/696; 239/708; 239/104; 239/106; 118/300; 118/621; 118/241; 427/479

(58) Field of Classification Search ..... 239/102.1, 239/695, 696, 708, 104, 106, 112, 290, 291; 118/300, 621, 624, 629, 241; 425/174.2, 425/174.8; 427/479
See application file for complete search history.

(56) References Cited

U.S. PATENT DOCUMENTS 4,495,885 A * 1/1985 Derks et al. ..... 427/600

(Continued)

FOREIGN PATENT DOCUMENTS

DE 28 42 232 A1 4/1980

(Continued)

OTHER PUBLICATIONS

Heinrich Kuttruff, "Fokussierung Von Ultraschall", Physik und Technik des Ultraschalls, 1988, pp. 121-124, S. Hirzel Verlag Stuttgart.

(Continued)

*Primary Examiner*—Tran Len
*Assistant Examiner*—James S Hogan
(74) *Attorney, Agent, or Firm*—Buchanan Ingersoll & Rooney PC

(57) ABSTRACT

The invention relates to an ultrasonic standing-wave atomizer arrangement for producing a paint spray mist for painting a workpiece, with a sonotrode, with a component arranged lying opposite the sonotrode, a standing ultrasonic field being formed in the intermediate space between the at least one sonotrode and the component in the case of operation. At least one nozzle-shaped paint feeding device is arranged perpendicularly in relation to the center axis of the sonotrode and introduces the paint into the intermediate space for the atomizing process at least one paint discharge point, the component arranged lying opposite the sonotrode being a coaxially aligned reflector, and the end face of the latter, facing the sonotrode, having a step-shaped recessed formation and the depth of said recessed formation corresponding to a multiple of half the wavelength λ of the sonic vibrations in air that are produced in the sonotrode.

15 Claims, 1 Drawing Sheet

U.S. PATENT DOCUMENTS

| | | | | |
|---|---|---|---|---|
| 4,597,533 | A * | 7/1986 | Shirai et al. | 239/701 |
| 4,647,471 | A * | 3/1987 | Jenkins | 427/580 |
| 4,748,043 | A * | 5/1988 | Seaver et al. | 427/482 |
| 4,981,425 | A | 1/1991 | Lierke et al. | |
| 5,122,047 | A | 6/1992 | Bauckhage et al. | |
| 5,164,198 | A | 11/1992 | Bauckhage et al. | |
| 5,387,444 | A * | 2/1995 | Bachmann | 427/600 |
| 6,758,555 | B2 * | 7/2004 | Bajeux | 347/77 |
| 7,083,322 | B2 * | 8/2006 | Moore et al. | 366/118 |
| 7,108,894 | B2 * | 9/2006 | Renn | 427/596 |
| 7,296,756 | B2 * | 11/2007 | Scharfenberger | 239/3 |
| 2002/0156400 | A1 | 10/2002 | Babaev | |
| 2005/0064088 | A1 * | 3/2005 | Fredrickson | 427/2.24 |
| 2005/0126480 | A1 * | 6/2005 | Yamagata et al. | 118/621 |

FOREIGN PATENT DOCUMENTS

| | | | |
|---|---|---|---|
| DE | 37 35 787 | A1 | 3/1989 |
| DE | 29 06 823 | A1 | 9/1990 |
| DE | 39 39 178 | A1 | 5/1991 |
| DE | 43 28 088 | A1 | 2/1995 |
| DE | 4328088 | A1 * | 2/1995 |
| EP | 0 251 524 | A2 | 1/1988 |
| EP | 0 257 825 | A2 | 3/1988 |
| EP | 0 308 600 | A1 | 3/1989 |
| JP | 58-174842 | A | 10/1983 |
| WO | 02/46097 | A1 | 6/2002 |

OTHER PUBLICATIONS

Michael M. Rielaender, "Reallexikon Der Akustik", Bibliothek des Deutschen Patentamtes, Sep. 3, 1982, pp. 154 and 444-445, Verlag Erwin Bochinsky, Frankfurt/Main.

Alfonso Barone et al., "Flexural Vibrating Free-Edge Plates With Stepped Thicknesses for Generating High Directional Ultrasonic Radiation", The Journal of the Acoustical Society of America, 1972, pp. 953-959, vol. 51, No. 3 (Part 2).

International Search Report dated Oct. 8, 2004 (with English translation of category of cited documents).

German Search Report dated Aug. 27, 2003 (with English translation of category of cite documents).

* cited by examiner

ULTRASONIC STANDING-WAVE ATOMIZER ARRANGEMENT

RELATED APPLICATIONS

This application claims priorities under 35 U.S.C. §119 to German Application No. 103 27 430.8, filed Jun. 18, 2003, and under 35 U.S.C. §371to PCT Application No. PCT/EP2004/005864, filed as an International Application on May 29, 2004 designating the U.S., the entire contents of which are hereby incorporated by reference in their entireties.

DESCRIPTION

The invention relates to an ultrasonic standing-wave atomizer arrangement for producing a paint spray mist for painting a workpiece, with at least one sonotrode, with a component arranged lying opposite the at least one sonotrode , a standing ultrasonic field being formed in the intermediate space between the sonotrode and the component in the case of operation. In addition, the ultrasonic standing-wave atomizer arrangement is provided with at least one nozzle-shaped paint feeding device, which is arranged perpendicularly in relation to the center axis arranged perpendicularly in relation paint into the intermediate space for the atomizing process at least one paint discharge point.

So far, coats of paint have been applied to the bodies of automobiles and similar articles of a large area in a known way by means of high-speed rotary atomizers, which produce a fine paint spray mist which is usually applied to the surface to be coated by suitable additional measures, for example in the case of electrically conductive paints by means of an electric field.

When using an environmentally friendly water-soluble base coat in such cases, coating rates of 200 ml/mm-400 ml/mm and above are achieved. The quality required for the coating, such as evenness of the surface and avoidance of bubbles, is achieved in particular by the diameters of the paint drops of the spray mist lying in the range of 10 μm<$d_{drop}$<60 μm.

The known high-speed rotary atomization has the following disadvantages, which can have an effect both on the product quality and on the required production expenditure. The atomization quality and the delivery are substantially determined by the form and rotational speed of the rotating bell, as the rotary part delivering the paint is referred to. Cleaned compressed air, which impinges on an air turbine coupled to the bell, is required for driving the bell. The cleaning of the compressed air causes additional expenditure.

As a result of the very high rotational speed of the rotary atomizers, at about 100,000 rpm, the paint particles accelerated in this way have a high initial velocity, which impairs their exact alignment with the areas to be coated, for example with the surface of a vehicle body, with the result that an appreciable amount of paint flies past the target area.

In addition, the amount of paint which can be delivered per unit of time when coating by means of high-speed rotary atomizers is limited, which in turn increases the amount of time required for applying the paint.

DE 102 45 324 and DE 102 45 326 disclose an ultrasonic standing-wave atomizer arrangement of the type mentioned at the beginning in which standing-wave atomization by means of ultrasound is used instead of high-speed rotary atomization. This has the following advantages in comparison with high-speed rotary atomization:

It involves replacing the rotating bell with a linearly vibrating ultrasonic sonotrode. This leads to an increase in the reliability or the service life of the atomizer. Furthermore, there is no longer any need for the driving air for the compressed air turbine, which is expensive because of the cleaning required. Also, the paint droplets have a lower initial velocity in the case of ultrasonic standing-wave atomization than in the case of high-speed rotary atomization, so that much less cleaned air is required to direct the paint spray mist onto the vehicle body. This in turn brings about on the one hand lower consumption of expensive cleaned and on the other hand of paint, since as a result of the reduced air flow less paint flies past the surface being painted.

Just to protect the reflector from being wetted by the paint, more expensive cleaning air is required than in the case of the sonotrode or, or a greater distance of the reflector from the sheet of paint has to be chosen. Since the sonotrode can be protected against being wetted by the paint more easily than the reflector, because the paint droplets are kept away from the sonotrode by the vibrations.

Consequently, unlike in the case of high-speed rotary atomization, in the case of ultrasonic standing-wave atomization the paint has no direct contact with the atomization device, thereby avoiding any wear because there is no abrasion. In the case of ultrasonic standing-wave atomization, the paint is usually applied with a spray cone of oval cross section. This can be advantageous when painting narrow parts.

The risk of wetting is also reduced if the end faces of the sonotrode and of the reflector are inclined with respect to one another, whereby a larger opening is produced for the discharge of paint. This can also be achieved by beveled end faces.

However, these measures have the effect that the ultrasound field in the atomization space is weakened. This is brought about by the sound waves or a certain element no longer traversing back and forth but partly leaving the atomization space. As a result, the rate of paint that can be atomized as a maximum is reduced.

On the basis of this prior art, the object of the invention is to provide an arrangement of the type mentioned at the beginning which, while having a simple configuration, offers an opening for the discharge of paint that is as large as possible, it being intended that the sound field used for this is weakened as little as possible, while at the same time the coating rate is as unchanged as possible, that is to say at the same time the delivery of paint is as unchanged as possible.

To achieve this object, it is provided according to the invention, in a way corresponding to the features of claim 1, that the component arranged lying opposite the sonotrode is a coaxially aligned reflector, the end face of which, facing the sonotrode, has a step-shaped offset and the depth of the offset corresponding to a multiple of half the wavelength of the sonic vibrations in air that are produced in the sonotrode.

In an advantageous development of the invention, the reflector is formed as a passive reflector, it preferably being formed as a plate, in particular as a circular disk-shaped plate, the cross section of which corresponds at least to that of the sonotrode used in the ultrasonic standing-wave atomizer arrangement.

According to a preferred embodiment of the invention, it proves to be favorable that the thickness of the reflector likewise corresponds to a multiple of half the wavelength of the sonic vibrations produced in the sonotrode, the thickness of the reflector being at least 10 mm.

In a way corresponding to one configuration of the invention, the step-shaped offset in the reflector is formed in the latter below the horizontal center axis of the reflector, the recessed formation having the form of a wedge to the form of a semicircle.

It follows from this in a development of the invention that the step-shaped offset in the reflector is formed in the end face of the reflector lying opposite the sonotrode in the form of a semicircle or in the manner of a sector, with an opening widening symmetrically in the spraying direction. That is to say that the step-shaped offset formed in the end face of the reflector in the manner of a sector may have an angle of opening $\alpha$ of $45° < \alpha < 180°$, the step-shaped offset formed in the end face of the reflector in the manner of a sector preferably having an angle of opening $\alpha$ of 135°.

These and further advantageous configurations and embodiments are the subject of the subclaims.

The invention, advantageous configurations and improvements of the invention and its particular advantages are to be explained and described in more detail on the basis of an exemplary embodiment that is represented in the accompanying drawing, in which.

Figure 1:
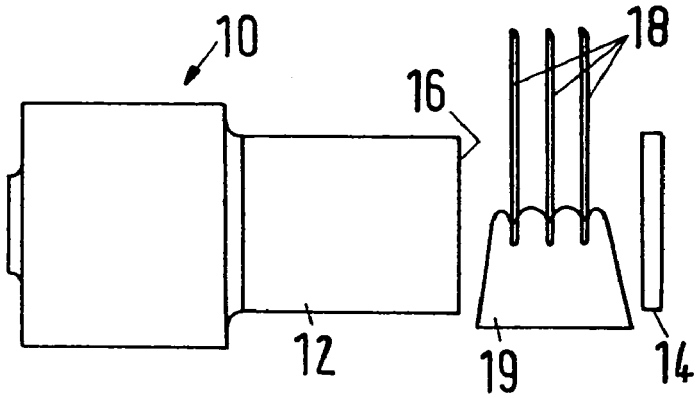
FIG. 1 shows a schematic side view of a first paint spraying arrangement, with a sonotrode with a uniform passive reflector.

Represented in FIG. 1 is a schematic side view of a first paint spraying arrangement 10, with a sonotrode 12 with a uniformly formed passive reflector 14, between which a standing wave is produced by the vibrations produced in the sonotrode 22 and emanating from its end face 16 facing the reflector 14, with individual sound particle velocity antinodes (not represented in any more detail here), in which paint feeding tubes 18 respectively enter and supply the paint intended for application, which takes the form of a spray cone 19 widening in the spraying direction and consequently brings about corresponding coverage with paint of the workpiece to be coated.

While the acoustic output area of the sonotrode 12, that is to say its end face 16, is not exposed to the risk of permanent wetting with the paint to be applied as a result of its state of vibration, this problem applied very much to the reflector 14, to the end face of which that is concerned the arrow P is pointing. To prevent wetting with paint, or to reduce it and remove the impinging paint, compressed air is usually used, supplied in the spraying direction—not represented in any more detail here.

Figure 2:
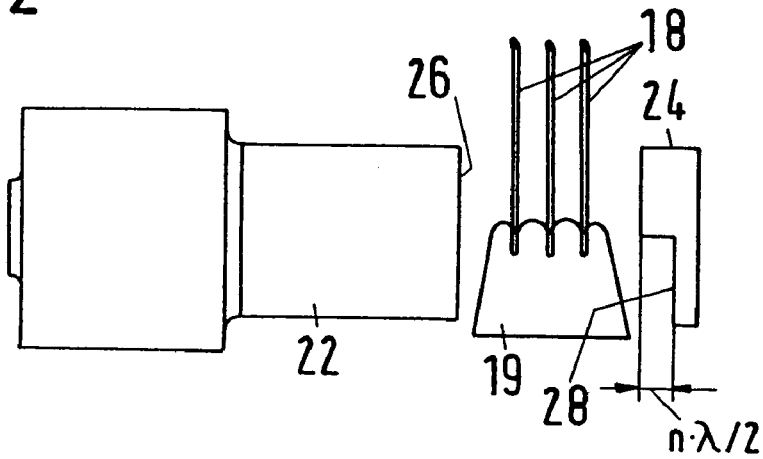
FIG. 2 shows a schematic side view of a second paint spraying arrangement, with a sonotrode with a stepped passive reflector.
Figure 3:
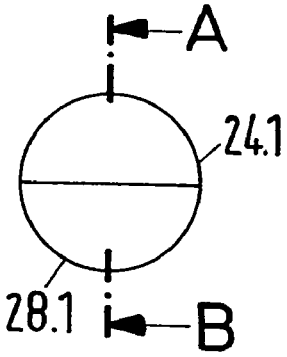
FIG. 3 shows an end-face view of a first stepped reflector.
Figure 4:
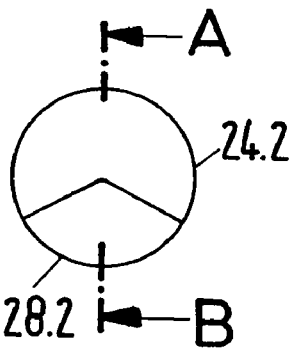
FIG. 4 shows an end-face view of a second stepped reflector.
Figure 5:
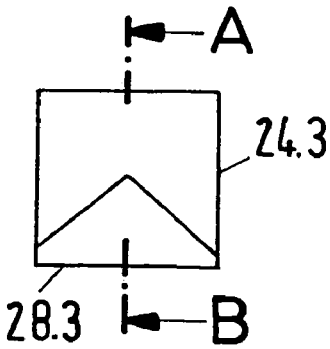
FIG. 5 shows an end-face view of a third stepped reflector.

FIG. 2 shows a schematic side view of a second paint spraying arrangement 20, with a sonotrode 22, such as that also already shown and described in FIG. 1, and also with a stepped passive reflector 24, shown here in longitudinal section A-B in a way corresponding to the representations in FIGS. 3 to 5, between which a standing wave is produced by the vibrations produced in the sonotrode 22 and emanating from its end face 26 facing the reflector, with individual sound particle velocity antinodes (not represented in any more detail here), in which paint feeding tubes 18 likewise enter and supply the paint intended for application, which takes the form of a spray cone 19 widening in the spraying direction and consequently brings about corresponding coverage with paint of the workpiece to be coated.

As a departure from the geometry of the reflector 14 that is represented in FIG. 1, the reflector 24 used here has a recessed formation 28 which reaches from its underside to the horizontal center line and which can be configured differently, in ways corresponding to the variants shown in FIGS. 3 to 5. The depth of the recessed formation 28 here is any desired multiple of half the wavelength $\lambda$ of sonic vibration in air.

Shown in FIG. 3 is the end-face view, facing the respective sonotrode, of a first stepped reflector 24.1, in the case of which the recessed formation 28.1 takes the form of a semicircle. Accordingly, the offset of the end surface of the reflector 24.1 takes place on the horizontal center line with an angle of opening $\alpha = 180°$.

Shown in FIG. 4 is the end-face view of a second stepped reflector 24.2, in the case of which the recessed formation 28.2 downwardly widens in the form of a wedge from the center of the circular reflector 24.2, with an angle of opening $90° < \alpha < 180°$.

Finally, shown in FIG. 5 is the end-face view of a third stepped reflector 24.3, which is formed as a rectangular plate, that is to say here as a square plate, and likewise has a wedge-shaped recessed formation 28.3, which widens downwardly and the angle of opening of which is provided in a way similar to the angle of opening shown in FIG. 4 of $90° < \alpha < 180°$.

The purpose of the recessed formation 28 according to the invention of the reflector 24.1, 24.2 and 24.3 is not to reduce unnecessarily the amount of paint to be delivered as such by the respective spraying device as a result of geometrically caused hindrance in the region of the reflector. With the aid of the recessed formations 28.1 to 28.3 according to the invention, it is now ensured that on the one hand the standing-wave field between the sonotrode and the reflector is not weakened as a result of phase unbalance of the standing waves and on the other hand a relatively large opening for the discharge of paint from the atomization space is created by the recessed formation.

The round or angular reflector may also have steps in the form of portions of a circle, segments of a circle and sectors of a circle, it being possible for the number of formed-in steps, their step height or depth and the position of the paint transporting tubes with respect to the segmented reflector to be chosen according to the application with regard to the criteria of maximum coating rate, low wetting risk, forming of the paint spray cone or most favorable electrostatic charging.

If need be, the reflector may be additionally provided with an air cushion.

Moreover, the widened opening has the advantage that, in the case of electrostatic charging in the vicinity of the sheets of paint, relatively high electric field strengths of 8<25 kV/cm) are possible, because the field-shielding effect of the reflector is reduced.

The invention claimed is:

1. An ultrasonic standing-wave atomizer arrangement for producing a paint spray mist for painting a workpiece, with a sonotrode, with a component arranged lying opposite the sonotrode, a standing ultrasonic field being formed in the intermediate space between the at least one sonotrode and the component in the case of operation, and also with at least one nozzle-shaped paint feeding device, which is arranged perpendicularly in relation to a center axis of the sonotrode and introduces the paint into the intermediate space for the atomizing process at least one paint discharge point, wherein the component arranged lying opposite the sonotrode is a coaxially aligned reflector, wherein the end face of the latter, facing the sonotrode, has a step-shaped recessed formation and wherein the depth of the recessed formation corresponds to a multiple of half a wavelength $\lambda$ of sonic vibrations in air that are produced in the sonotrode.

2. The ultrasonic standing-wave atomizer arrangement as claimed in claim 1, wherein the reflector is formed as a passive reflector.

3. The ultrasonic standing-wave atomizer arrangement as claimed in claim 2, wherein the reflector is formed as a circular disk-shaped plate or as a rectangular plate.

4. The ultrasonic standing-wave atomizer arrangement as claimed in claim 3, wherein the thickness of the reflector likewise corresponds to a multiple of half a wavelength of sonic vibrations produced in the sonotrode.

5. The ultrasonic standing-wave atomizer arrangement as claimed in claim 1, wherein the thickness of the reflector is at least 10 mm.

6. The ultrasonic standing-wave atomizer arrangement as claimed in claim 1, wherein the step-shaped recessed formation in the reflector is formed in the latter below a horizontal center axis of the reflector.

7. The ultrasonic standing-wave atomizer arrangement as claimed in claim 6, wherein the step-shaped recessed formation in the reflector is formed in the end face of the reflector lying opposite the sonotrode in the form of a semicircle.

8. The ultrasonic standing-wave atomizer arrangement as claimed in claim 6, wherein the stepped-shaped recessed formation in the reflector is formed in the end face of the reflector lying opposite the sonotrode in the manner of a sector, with an opening widening symmetrically in the spraying direction.

9. The ultrasonic standing-wave atomizer arrangement as claimed in claim 8, wherein the sector-like stepped-shaped recessed formation in the end face of the reflector has an angle of opening $\alpha$ of $45° < \alpha < 180°$.

10. The ultrasonic standing-wave atomizer arrangement as claimed in claim 9, wherein the sector-like step-shaped recessed formation in the end face of the reflector has an angle of opening $\alpha$ of 135°.

11. The ultrasonic standing-wave atomizer arrangement as claimed in claim 4, wherein the thickness of the reflector is at least 10 mm.

12. The ultrasonic standing-wave atomizer arrangement as claimed in claim 2, wherein the step-shaped recessed formation in the reflector is formed in the latter below a horizontal center axis of the reflector.

13. The ultrasonic standing-wave atomizer arrangement as claimed in claim 3, wherein the step-shaped recessed formation in the reflector is formed in the latter below a horizontal center axis of the reflector.

14. The ultrasonic standing-wave atomizer arrangement as claimed in claim 4, wherein the step-shaped recessed formation in the reflector is formed in the latter below a horizontal center axis of the reflector.

15. The ultrasonic standing-wave atomizer arrangement as claimed in claim 5, wherein the step-shaped recessed formation in the reflector is formed in the latter below a horizontal center axis of the reflector.

* * * * *